US005199228A

United States Patent [19]

Beausoleil

[11] Patent Number: 5,199,228

[45] Date of Patent: Apr. 6, 1993

[54] SANDBLASTING SYSTEM AND PROCESS

[76] Inventor: Normand R. Beausoleil, 717, Rang St-Amable, St-Gabriel-de-Brandon, Quebec, Canada, J0K 2N0

[21] Appl. No.: 868,527

[22] Filed: Apr. 15, 1992

[30] Foreign Application Priority Data

Apr. 19, 1991 [GB] United Kingdom ..... 9108518

[51] Int. Cl.[5] ..... B24C 3/10; B24C 9/00

[52] U.S. Cl. ..... 51/417; 51/410; 51/426; 51/429

[58] Field of Search ..... 51/429, 410, 417, 426

[56] References Cited

U.S. PATENT DOCUMENTS

| | | | |
|---|---|---|---|
| 4,001,977 | 1/1977 | Schrader | 51/426 |
| 4,031,666 | 6/1977 | West | 51/426 |
| 4,064,656 | 12/1977 | Zeidler | 51/429 |
| 4,139,970 | 2/1979 | Hockett | 51/429 |
| 4,255,906 | 3/1981 | Hockett | 51/429 |
| 4,793,103 | 12/1988 | Baumgart | 51/418 |
| 4,825,598 | 5/1989 | Schlick | 51/429 |

FOREIGN PATENT DOCUMENTS

| | | | |
|---|---|---|---|
| 48508 | 8/1985 | Fed. Rep. of Germany | 51/429 |

*Primary Examiner*—Bruce M. Kisliuk
*Assistant Examiner*—Bo Bounkong
*Attorney, Agent, or Firm*—Roland L. Morneau

[57] ABSTRACT

A system for sand blasting includes a longitudinally protecting wall provided with a horizontal slit therethrough, a control center having a platform longitudinally displaceable in front of the wall and a seat on the platform which can be vertically displaced relative to the slit. A sand blasting gun is mounted on the platform between the wall and the seat and extends through the slit. The gun is pivotally mounted on a post substantially in the plane of the wall for allowing the gun to be directed in a plurality of angular directions across the slit. A stand for supporting an article having a large surface to be treated is located on the side of the wall opposite the chair. The stand is adapted to pivot the article about a vertical and a horizontal axis whereby the gun is adapted to laterally project sand on the article when the platform is displaced from side to side along the slit and when the gun and the stand are pivoted about their vertical axis. The gun is also adapted to upwardly and downwardly blast the article when the gun and the stand are pivoted about a horizontal axis.

9 Claims, 8 Drawing Sheets

SANDBLASTING SYSTEM AND PROCESS

BACKGROUND OF THE INVENTION

The present invention is directed to a method and a process for surface treatment and, in particular, for sandblasting a large surface which is uneven.

The blasting is made with sand or a combination of sand and water for the elimination of rust, chipped paint, welding residue and the like. The treatment system is particularly adapted for projecting the sand or other material in a plurality of angular directions relative to the plane of the surface to be treated so that even the surface which has an intricate relief configuration can be handled satisfactorily.

The present system is also contemplated for projecting cleaning liquid, oil or powdered material.

The novel system is particularly adapted for the treatment of large surfaces such as truck boxes for vans or small platforms for trailors. The side and the doors of such surfaces display a large variety of reliefs.

In order to provide an adequate surface treatment for surfaces having such characteristics, the material being propelled must selectively move in or away from the surface to be treated. The nozzle of the spraying gun must angularly move according to a vertical and a horizontal axis so as to follow the exact shape of the surface to be treated including concealed corners.

Furthermore, considering that the system is contemplated for treating different types of surfaces, its manipulation must be simple and the projected material quickly displaced.

Prior Art

Canadian patent No. 521,075 makes use of an angularly adjustable gun but the latter can not be moved in and away from the surface to be treated. Accordingly, it would be impossible to handle the treatment of surfaces having a large variety of dimensions and reliefs.

Canadian patent No. 1,032,348 and U.S. Pat. No. 3,898,768 are directed to the method of treating surfaces in a continuous manner. The concept of such a continuity is accordingly inadequate for surfaces having constantly different relief contours.

U.S. Pat. No. 4,048,758 is not adapted for a selective treatment on various surfaces. It operates for a plurality of identical work pieces which pass in succession when the machine is in use. This machine is particularly interested in the treatment of inner boundary walls of arcute cabins through a horizontal slot.

SUMMARY OF THE INVENTION

The invention is directed to a surface treatment system and process for relatively large sized articles. It provides a shelter for housing an operator or controller provided with means for controlling various shifting of its own position and for moving the article to be treated and the relative movement of both the article relative to the position of the operator. Sand or the like is projected by a gun through a slit in the shelter in a plurality of angular directions commensurate with a conical angle substantially representing half a sphere. The article is pivotally supported on a stand located outside the shelter for orienting the article in a plurality of angles relative to the position of the operator. The article is also adapted to move longitudinally along the slit relative to the position of the operator.

The system includes a longitudinally projecting wall provided with a horizontal slit therethrough, a control center having a platform longitudinally displacable in front of the wall and a seat mounted on the platform with means adapted to vertically displace the seat relative to the slit. A sand blasting gun is mounted on the platform between the wall and the seat and extending through the slit. The gun is pivotally mounted on a post substantially in the plane of the wall for allowing the gun to be directed in a plurality of angular directions across the slit. A stand for supporting an article having a large surface to be treated is located on the side of the wall opposite the chair. The stand is provided with means for pivoting the item about a vertical and a horizontal axis whereby the gun is adapted to laterally project a material such as sand on the article when the platform is displaced from side to side along the slit and when the gun and the stand are pivoted about their vertical axis. The gun is also adapted to upwardly and downwardly blast the article when the gun and the stand are pivoted about a horizontal axis.

DETAILED DESCRIPTION OF THE INVENTION

Figure 1:
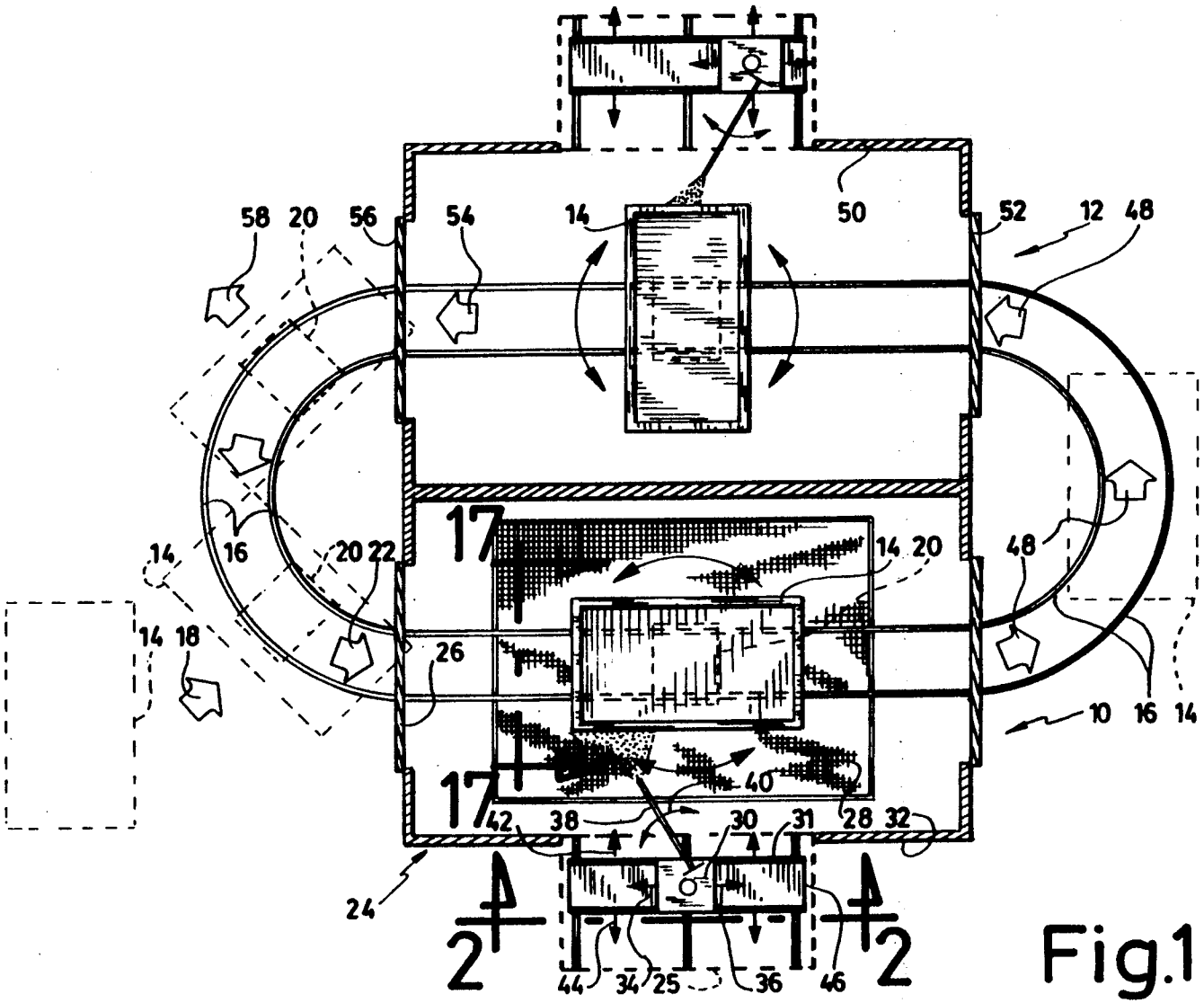
FIG. 1 is a schematic top view of a blasting system according the invention including two stages for treating the surfaces of an article.

The schematic top view of an embodiment of the invention shown in FIG. 1 includes a two part operation wherein the sand blasting occurs in part 10 and the painting operation occurs in part 12. An article 14 which has one or a plurality of surfaces to be treated is moved onto the pathway or rails 16 in the direction of the arrow 18 by a crane (not shown). A stand 20 which is adapted to move on the pathway 16 in the direction the arrow 22. The article 14 enters the housing 24 through a retractable door 26. The housing 24 completely surrounds the article 14 which is substantially located at about its center and over a grid 28 adapted to allow the sand, throughout the sand blasting operation, to return it to a suitable reservoir or further use. As will be explained later, the stand 20 is adapted to pivot so as to move the article 14 and a plurality of orientation while located inside the housing 24. The sand blasting is performed from a control center 30 adapted to move parallel to the wall 32 in the direction of the arrows 34 and 36. The sand blasting gun 38 extends through a horizontal slit through a wall 31 and is adapted to pivot in a plurality of angular directions including the direction of the arrow 40. The control center 30 is also adapted to move back and forth in the direction of the arrows 42 and 44. The shelter 46 within which the control center 30 is adapted to move, forms a lateral extension of the housing 24 and is connected to the housing 24 by a curtain wall 25 to prevent the loss of the sand projected and to dampen the sound.

After the article 14 located inside the housing 24 has been satisfactorily sand blasted, it is moved in the direction of the arrows 48 along the pathway 16 to reach a painting chamber 50 after it went through a retractable door 52.

The painting operation is made in a substantially corresponding manner as the sand blasting operation and is illustrated to show that the novel system and method is adaptable for all kinds of surface treatment. After the painting operation has occurred in the chamber 50, the article 14 moves in the direction of the arrow 54 through another retractable door 56 so as to be removed by a crane in the direction of the arrow 58 from the stand 20.

FIG. 1 is intended to illustrate the general structure, function and operation of the invention according to the novel system of the present invention.

Figure 2:
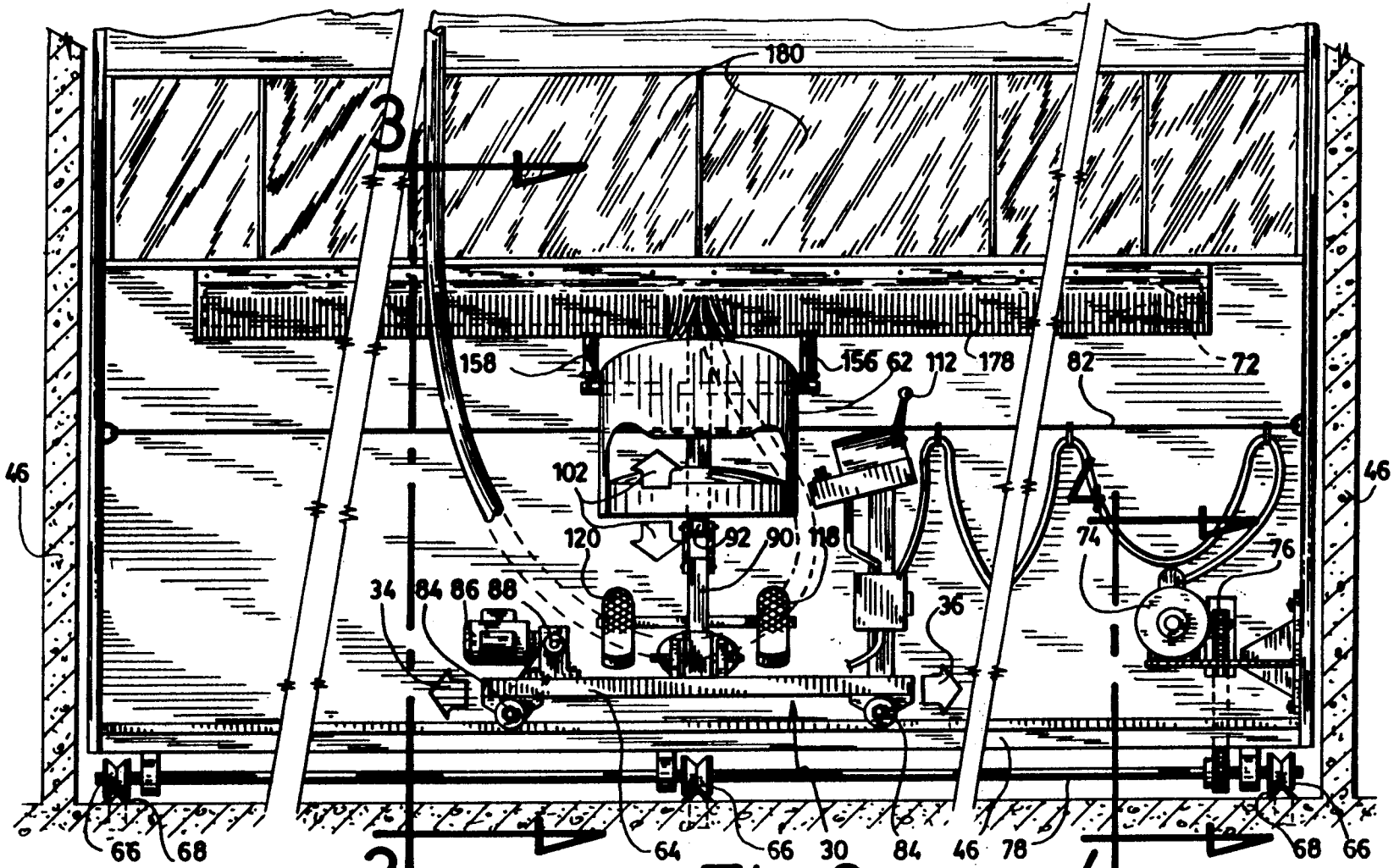
FIG. 2 is a rear view of a control center shown along line 2—2 of FIG. 1.
Figure 3:
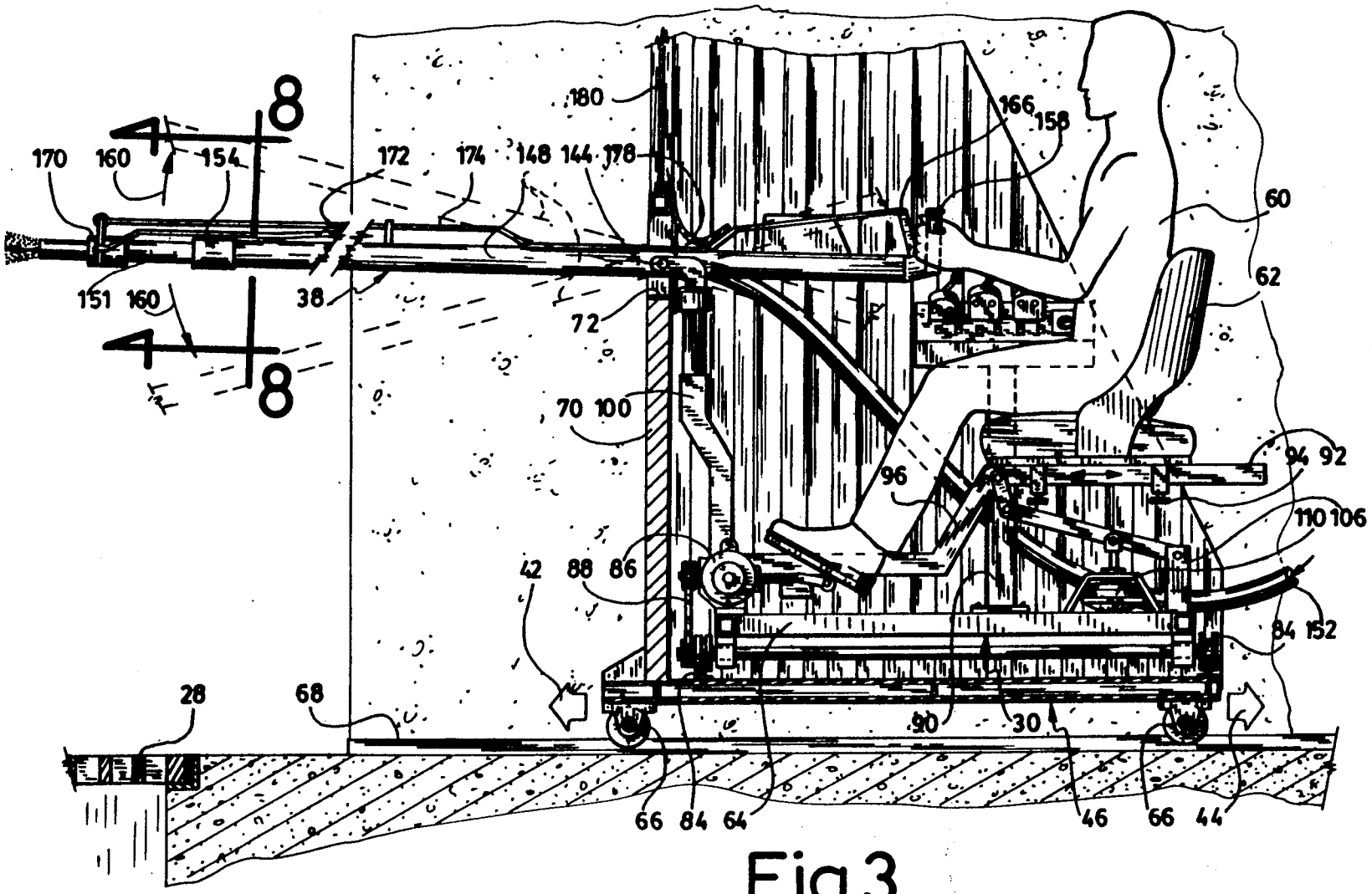
FIG. 3 is a side view of the control center seen along line 3—3 of FIG. 2.

FIGS. 2 and 3 illustrate the control center 30 inside the shelter 46. The operator 60 operating the sandblasting gun 38 is positioned in the seat 62 mounted on a platform 64 of the control center 30. The shelter 46 is mounted on wheels 66 over guiding rails 68 to allow a back and forth movement along the arrows 42 and 44. The shelter 46 includes a front wall 70 adapted to move with the shelter 46. The wall 70 is provided with a horizontal slit 72 through which the sand blasting gun 38 extends. The wheels 66 are adapted to be moved on the guiding rail 68 by a motor 74 connected through a chain and sprocket system 76 connected to an axle 78. The motor 74 is electrically controlled through a flexible wire 80 connected to the control center 30. The flexible cable 80 is loosely suspended on a steel cable 82 to allow free lateral movement of the control center 30 along the arrows 34 and 36.

Figure 3A:
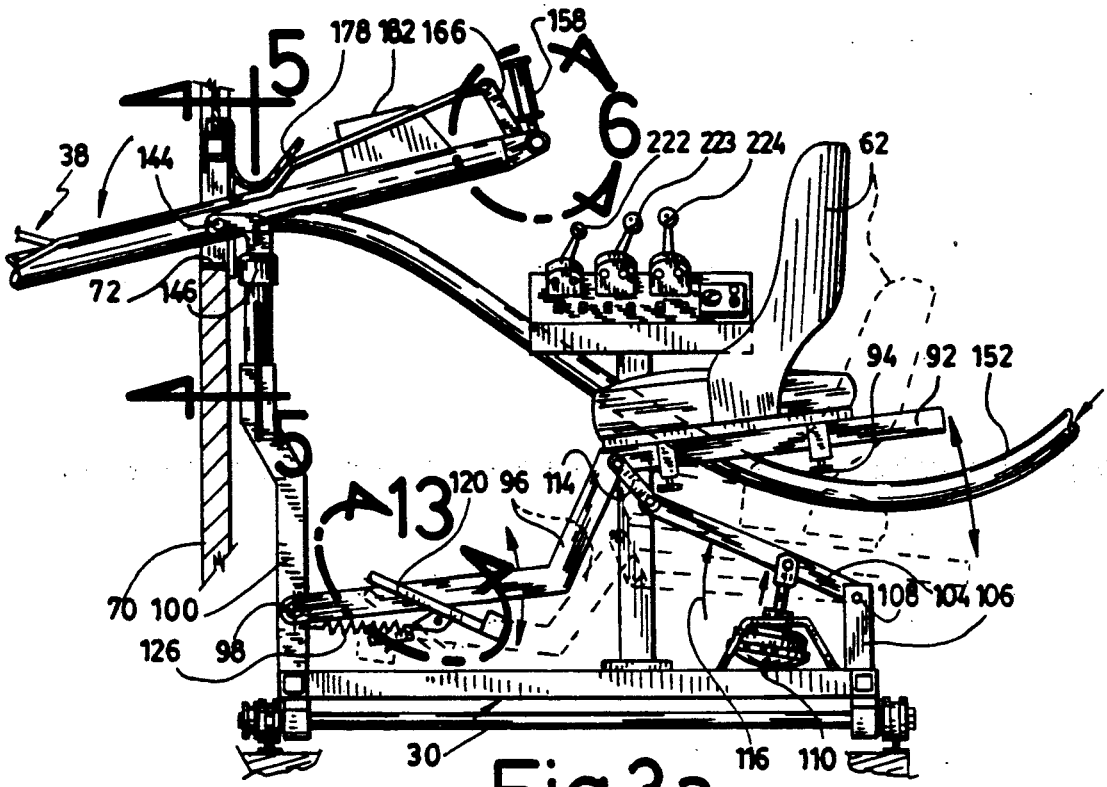
FIG. 3*a* is a view substantially corresponding to FIG. 3 with the seat of the operator in different positions.

The platform 64 of the control center 30 is mounted on wheels 84 and are actuated by a motor 86 through a chain and sprocket arrangement 88. The seat 62 is mounted on the platform 64 and is supported by a vertical shaft 90. The seat 62 is longitudinally adjustable on a substantially horizontal frame 92 and can be locked in place with tightening means 94. The seat 62 and the frame 92 are connected by a lever 96 to an axle 98 supported by a post 100. The post 100 is mounted in front of the seat 62 and secured at its lower end to the platform 62 adjacent the wall 70. The seat 62 is provided with a vertically adjustable device for moving the seat substantially in the direction of the arrow 102. For this purpose, a lever 104 is mounted between the lever 96 and a shaft 106 and is adaped to be vertically raised about an axle 108 by a pneumatic piston 110 located under the lever 104. The pneumatic piston 110 is actuated by air valves, the air of which is supplied by a compression used for projecting sand. One valve adapted to increase the pressure in the piston 110 and to raise the seat 62 is operated by the button 111 mounted on the handle bar 142 adjacent the left handle 158. Another valve adapted to decrease the pressure in the piston 110 and to lower the seat 62 is operated by the button 113 mounted on the handle bar 142 adjacent the right handle 156. A link 114 is freely pivoted between the frame 106 and the lever 104 to provide for the needed radial adjustment of the lever 104 relative to the frame 96. The need for raising the seat will become obvious with the subsequent description of the system that is particularly intended to adjust the height and the posture of the operator 60 according to the angular direction of the blasting gun 38. When the pneumatic piston 110 is raised in the direction of the arrow 116, it raises the angle of the lever 104 and accordingly raises the level of the seat 62 as particularly shown in FIG. 3*a*.

A pair of pedals 118 and 120 are mounted in front of the seat 62 and are supported by the lever 96 adjacent the post 100. When the seat 62 is raised, the feet remain substantially fixed relative to the seat.

Figure 16:
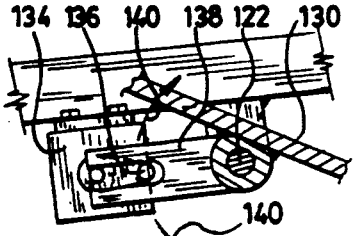
FIG. 16 is a cross-sectional view taken along line 16—16 of FIG. 15.
Figure 13:
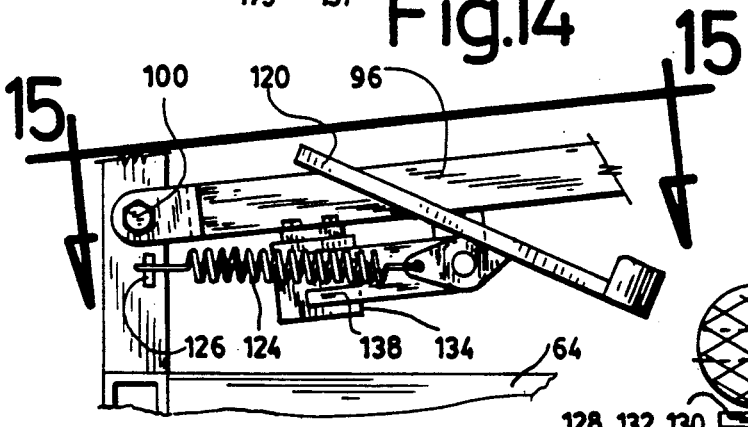
FIG. 13 is an enlarged view of encircled portion 13 of FIG. 3*a*.
Figure 15:
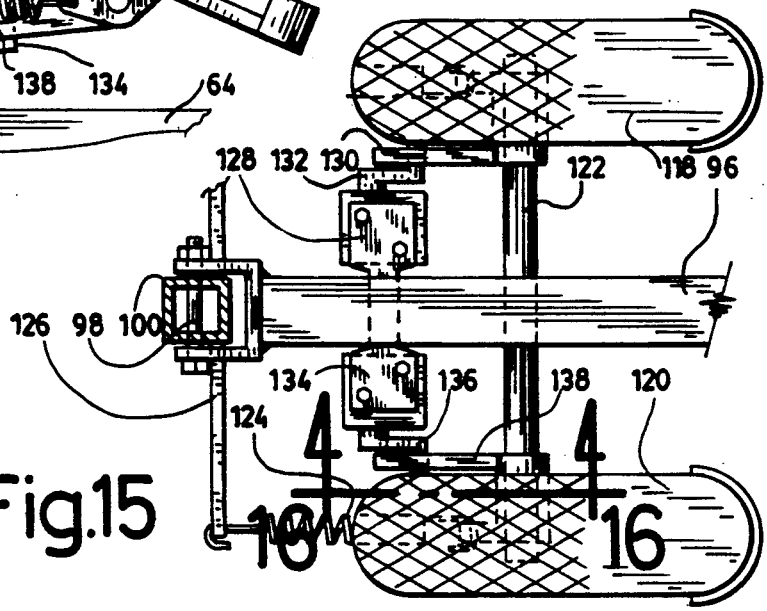
FIG. 15 is a top view of the pedal control device taken along line 15—15 of FIG. 13.
Figure 17:
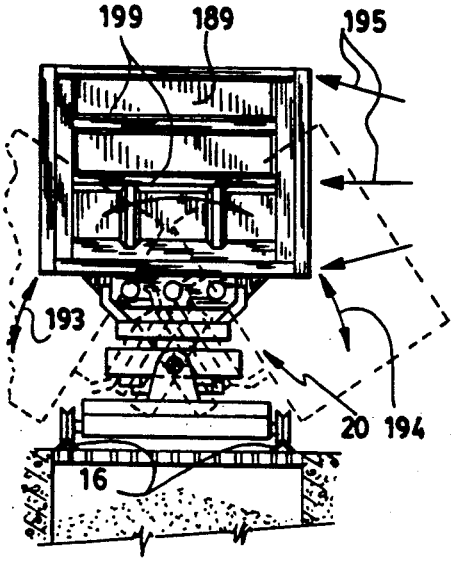
FIG. 17 is a side view of a stand supporting a truck box taken along line 17—17 of FIG. 1.
Figure 17A:
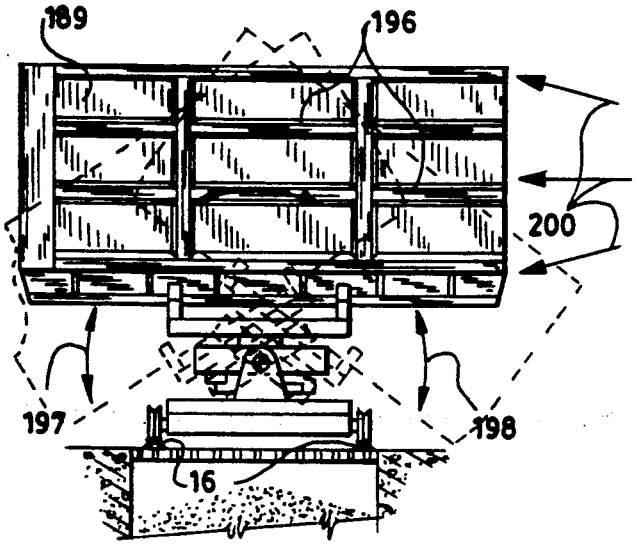
FIG. 17*a* is a side view of the stand and the box shown in FIG. 17.

As particularly shown in FIGS. 13, 15 and 16, the pedals 118 and 120 are pivotally mounted on an axle 122 and tends to be maintained in a slightly inclined position by a coil spring 124 forwardly connected to a plate 126. The pedals are intended to operate motors 74 and 86 to allow the back and forth displacement of the shelter 46 and the lateral movement of the control center 30. For this purpose, pedal 118 is connected to a reversible switch 128 through the combination of a pair of levers actuated by the axle 122. Switch 128 is connected to the motor 74. By pivoting the pedal about the axle 122, the switch 128 is actuated to either move forward or backward the shelter 46 and such a movement is intentionally produced by the person sitting in the seat 62. Similarly, the control center 30 is laterally moved along the arrows 34 and 36 by the motor 86 which is actuated by the reversible switch 134 connected to the axle 122 by a pair of levers 136 and 138. As particularly shown in FIG. 16, the tilting movement of the pedal 130 along the arrrows 140, actuates the lever 136 upwardly and downwardly in order to obtain the reversible swtiching of the motor 86.

With the arrangement as already explained, the operator, while sitting in his seat-62, can move his seat up and down by actuating the buttons 111 and 113 and is able to move the shelter 46 and the control center 30 by actuating the pedals 118 and 130.

Figure 5:
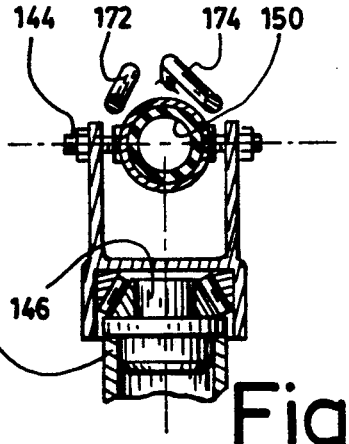
FIG. 5 is a cross-sectional view taken along line 5—5 of FIG. 3*a*.
Figure 4:
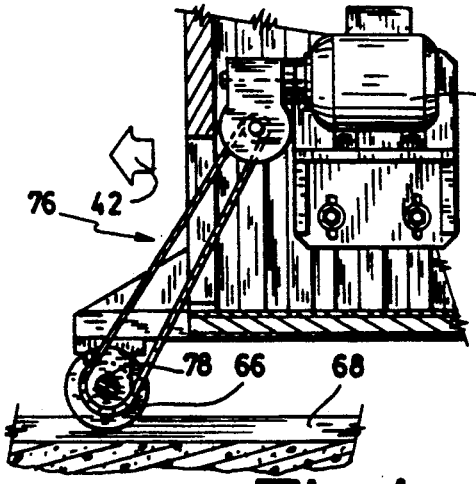
FIG. 4 is a side view of the driving mechanism for moving the shelter.
Figure 8:
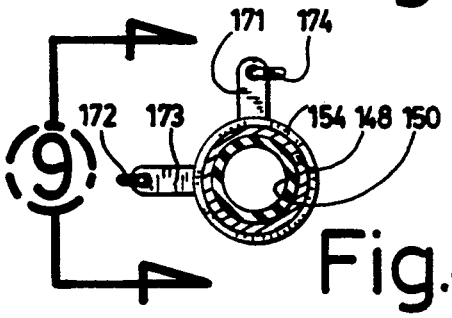
FIG. 8 is a cross-sectional view taken along line 8—8 of FIG. 3.

The blasting gun 38 is positioned in front of the seat 62 and is pivotally fixed at the top of the post 100 one portion extending inside the shelter 46 and another portion extending outside in the direction of the article 14 to be blasted. The gun 38 is connected to the post 100 through a handle bar 142. The gun 38 is mounted on a horizontal axle 144 located in the plane of the wall 70 to allow the gun to move up and down and around a vertical axle 146 as particularly detailed in FIG. 5. With this combination of axles, it is possible to direct the gun in a variety of angles substantially corresponding to half a sphere while having a rather narrow slit 72.

Figure 6:
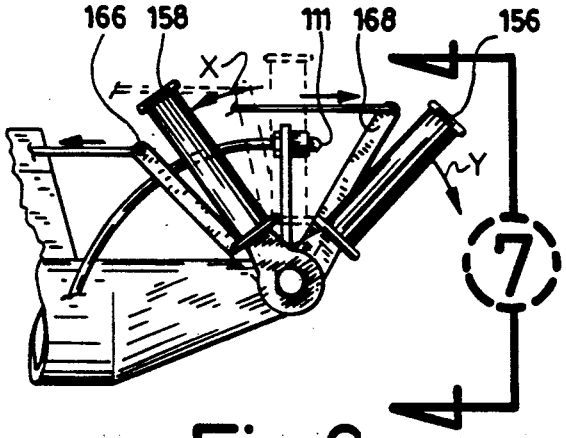
FIG. 6 is an enlarged view of encircled portion 6 shown in FIG. 3*a*.
Figure 10:
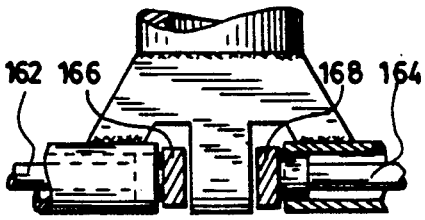
FIG. 10 is a side view of the central portion of the handle bar taken along line 10—10 of FIG. 7.
Figure 7:
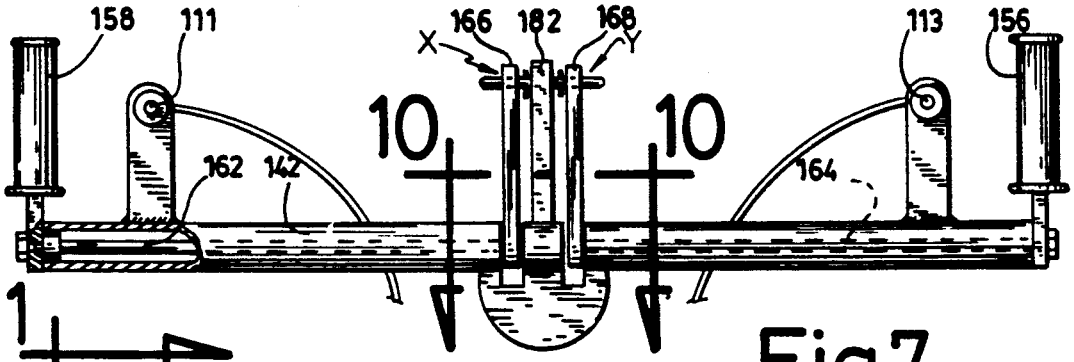
FIG. 7 is a side view of the handle bar shown along arrows 7 of FIG. 6.
Figure 9:
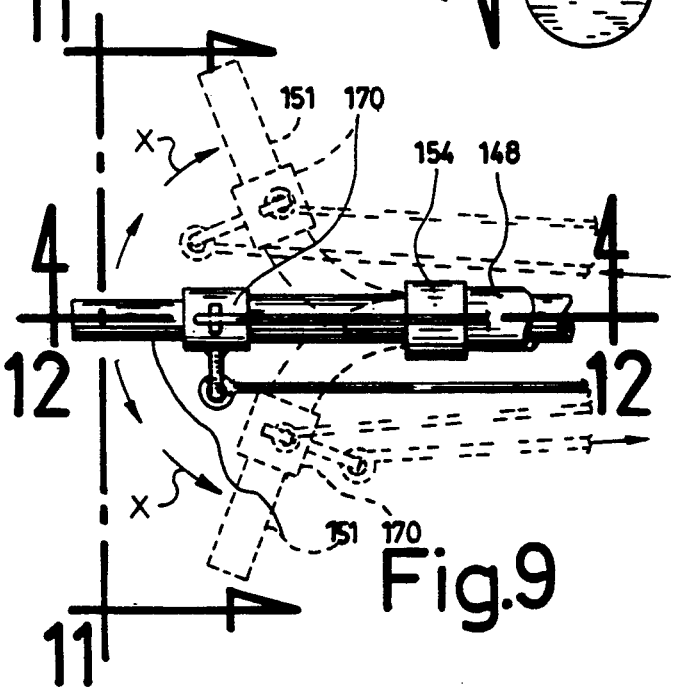
FIG. 9 is a side view of the nozzle of the gun taken along arrows 9 of FIG. 8.

The gun 38 is generally made of a metal sleeve lined with a rubber sleeve 150 which is an extension of a rubber hose 152 which brings the sand or the treatingg material to the gun at a minimum speed. The rubber hose 150 extends forwardly of the ring 154 constituting the forward end of the metal sleeve 148. The forward end of the rubber lining 151 is adapted to be bent through a mechanism controlled by a pair of handles 156 and 158 fixed at each end of the handle bar 142. The functions of the handles 156 and 158 are two-fold. First they serve to move the gun 38 in an up and down direction as shown by the arrows 160 (FIG. 3) and laterally from side to side. Second, they serve to actuate the flexible nozzle portion 151 of the gun 138 as shown in FIG. 9. For this purpose, the handles 156 and 158 are connected to two central shafts 162 and 164 axially extending inside the handle bar 142. Each shaft 162 and 164 is respectively secured to a lever 166 and 168 upwardly extending about the center of the handle bar 142. As particularly shown in FIG. 6, the tilting of the handle 156 produces a substantially corresponding tilting motion of the lever 168 and similarly, the tilting of the handle 158 produces a tilting motion of the lever 166.

Figure 11:
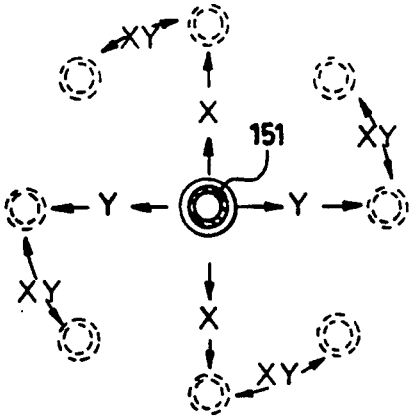
FIG. 11 is a schematic illustration of the movement of the gun nozzle shown along arrows 11—11 of FIG. 9.
Figure 12:
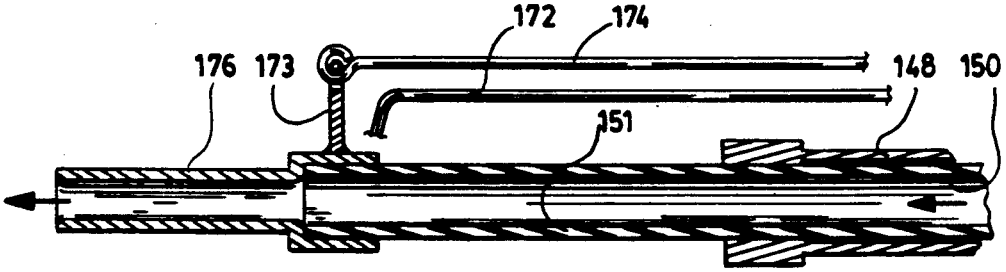
FIG. 12 is a cross-sectional view taken along line 12—12 of FIG. 9.
Figure 14:
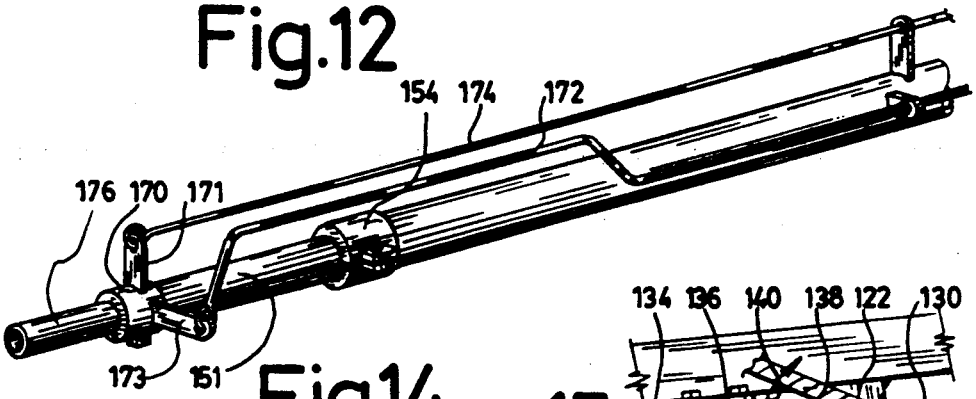
FIG. 14 is a perspective view of the forward portion of the gun for blasting.

The upper end of the lever 166 is provided with a linkage system extending along the gun 38 which is fixed to a ring 170 surrounding the nozzle 151 is front of the ring 154 so as to provide a flexible portion between ring 154 and 170. The linkage system 172 is eccentrically fixed to the ring 170 by a pair of arms 171 and 173 so that when the lever 166 is actuated, the nozzle 151 will laterally move sideways substantially as shown in FIG. 9 along the arrows X and schematically identified in FIG. 11. A corresponding movement in obtained by tilting the handle 156 for producing a longitudinal movement of the linkage 174 along the gun 138 for producing a vertical movement of the nozzle 151 along the axis Y as schematically shown in FIG. 11. With this arrangement, it is possible to pivot the nozzle 151 at an angle exceeding 90 degrees relative to the axis of the metal sleeve 148. The combination of such a pivoting action combined with the above mentioned orientation of the metal sleeve 148 in a large variety of direction allows the blasting gun to reach practically any relief configuration of the article to be blasted.

Although the innermost lining 150 may be made of a flexible material such as synthetic rubber, the endmost portion 176 of the nozzle is preferably made of a very hard mixture of centered carbides of various metals because, as explained previously, that part of the nozzle is bent relative to do general longitudinal axis of the gun 38 and could erode quickly when a material such as sand needs to change its pathway.

The gun 38 extends through the front wall 70 across a longitudinal slit 22 which allows the gun to move sideways with the lateral displacement of the control center 30. The slit 72 is covered by vertically slotted curtains 178 which are not a hindrance to the displacement of the gun 38 but which will stop the material used for the surface treatment such as sand. Such curtains 178 are made of a material which is easily flexible while having a sufficient weight to maintain a vertically pending orientation when not disturbed by the gun 38. A heavy gage rubber is generally used for this purpose.

The front wall 70 is also provided with a transparent window 180 across the front wall 70 to provide a suitable visibility for the operator while treating or sanding an article such as 14. The surrounding walls of the shelter may be covered by a rubber layer (not shown) to dampen the sound caused by the sand blasting.

The portion of the gun 38 inside the shelter is generally shorter than the portion extending outside the shelter 46 and for this purpose, requires a weight 182 to counterbalance the weight of the gun 38 and to help the operator in its easy manipulation of the gun.

Figure 18:
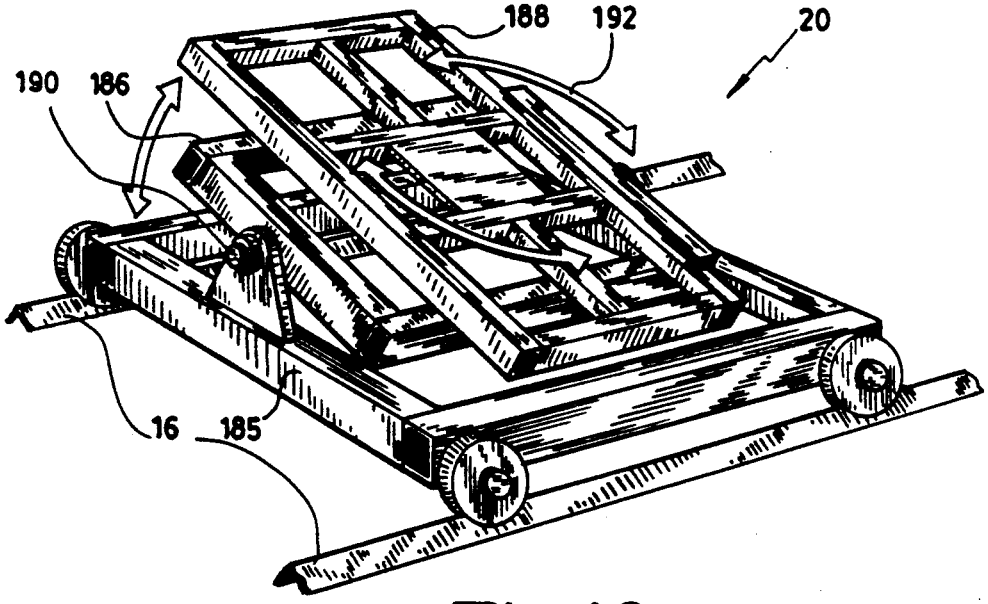
FIG. 18 is a perspective view of the stand for supporting an article to be treated.

The stand 14 which moves along the rails 16 of the pathway is particularly illustrated to FIG. 18. It is supported by a set of wheels 184 and is provided with a fixed frame 185 and a pair of superposed frames 186 and 188. Frame 186 is pivoted around a horizontal axle 190 substantially parallel to the front wall 32 when facing the latter, and the frame 188 is pivoted about an axle perpendicular to the frame 186 in order to provide a rotation of the article 14 in the direction of the arrows 192. When the box of a truck is secured on the frame 188, the controller 60 will be able to tilt the box 189 along the arrows 193 and 194 when the sand is blasted in the direction of the arrows 195. Such a tilting operation will be required in order to provide access, by the nozzle 176 under and over configuration in relief such as ribs 196. Similarly, when the box 189 is pivoted 90 degrees relative to the rails 16, the box 189 will be tilted along the arrows 197 and 198 to allow the nozzle 176 to have access over and under the ribs 199 when the sand is projected in the direction of the arrows 200. The tilting of the box 189 also allows the sand blasting operation under and over the box as shown in FIG. 19.

Figure 19:
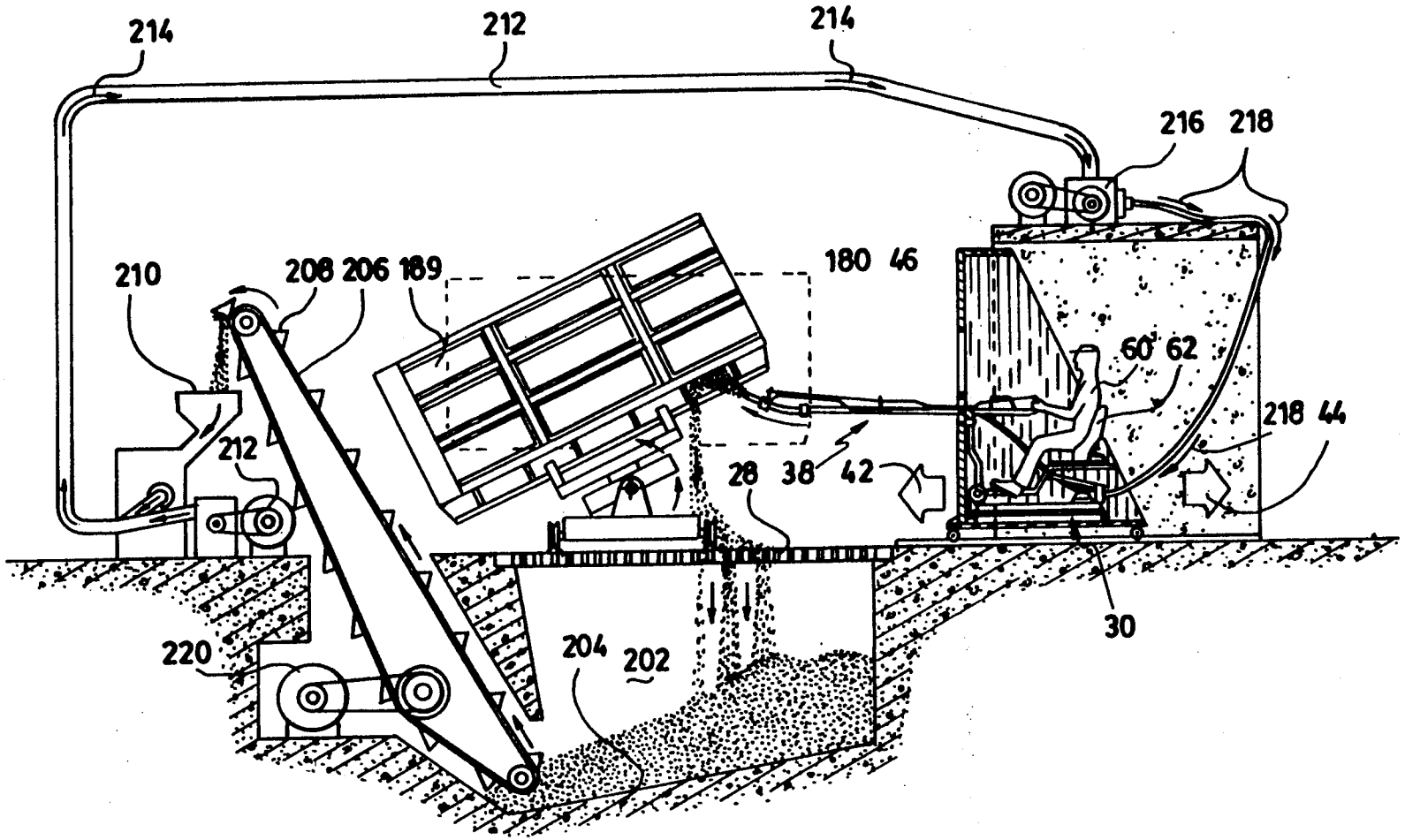
FIG. 19 is a side view of a schematic representation of a surface treatment according to the invention.

The general operation of the system for treating the surface of articles is broadly illustrated in FIG. 19. The operator 60 sitting in the seat 62 on the control center 30 inside the shelter 46 is provided with the means to move forwardly and backwardly along the arrow 42 and 44 while holding the gun 38 which will blast the sand on the surface of the box 189. He is adapted to maintain a relatively constant position in his seat while the latter may be moved upwardly and downwardly and laterally and while maintaining a good visibility through the window 180 of the article 189 to be blasted. Considering that the present invention is particularly directed to the surface treatment of very large articles such as truck boxes, the back and forth movement and lateral movements of the operator is important for maintaining the housing 24 within reasonable dimensions. The volume of the housing 24 will have to be much greater if the system would not be provided with the possibility of spacing the shelter from the truck box. In addition, the nozzle being adapted to bend sideways and vertically, allows to restrict the upward and downward movement of the truck box 189. Accordingly, the combination of the various movements of the truck box over the stand 20 and the movements of the gun 38 from the shelter in the direction of the box 189 allows the treatment and particularly the sand blasting of surface having practically all the relief designs possible.

After the sand has been used for blasting, it falls through grid 28 into a basement 202 having an inclined floor 204 which constantly moves the sand into the direction of a belt conveyer 206. The belt conveyer 206 is provided with a series of buckets 208 which being the sand into a funnel 210. A blower 212 provides a draft which according to the Venturi principle, will lead the sand into the tubular arrangement 212 in the direction of the arrows 214 until it reaches a blower 216 which will drive the sand at the required minimum speed towards the gun 38 is the direction of the arrows 218. The control of the conveyor, through the motor 220, and of the blower 212 and 216, is supplied by a set of handles 222, 223 and 224 handily mounted on a control panel adjacently positioned on the right hand side of the seat 62.

I claim:

1. A surface treatment system adapted to project a material, said system comprising, a vertical flat protecting wall provided with a narrow slit horizontally extending across said wall, said wall has a transparent window extending above the slit, a control center mounted on a platform longitudinally displaceable parallel to said wall, along one side thereof, an operator's seat mounted on said platform, and means for vertically displacing said seat relative to said slit, a stand for supporting an article having a large surface to be treated, said stand mounted in a blasting housing located on a side of the wall opposite the seat, means for pivoting said stand about a vertical and a horizontal axis, an elongated tubular gun extending through said slit of said wall into said housing for projecting said material in said housing, said gun being pivotally mounted on a post fixed on said platform adjacent said wall, said gun being pivoted on said post for projecting around vertical and horizontal axis of an angle of about 180 degrees, said gun extending between said housing and said seat through said slit, said gun having a pair of handles for manually directing said gun in a plurality of angular directions across and along said slit, a movable shelter for said control center, said shelter having a substantially horizontal floor fixed to said protecting wall, means for moving said shelter in a direction perpendicular to said wall, actuating means mounted on said platform for moving said platform on said floor parallel to said wall, said control center comprising first and second pedals located between said seat and said wall, said pedals adapted to be actuated by an operator sitting on said seat, a first electric switching device and a first lever adapted to be actuated by said first pedal for operating said first switching device for actuating said shelter moving means, a second electric switching device and a second lever adapted to be actuated by said second pedal for operating said second switching device for moving said platform, whereby said gun is adapted to laterally project said material on said article when the platform is laterally displaced from side to side along said slit, and when the gun and the stand are pivoted about their vertical axes and whereby the gun is adapted to upwardly and downwardly project said material on said article when the gun and the stand are pivoted about a horizontal axis.

2. A surface treatment system as recited in claim 1, comprising a first beam for supporting said seat, said first beam being pivotally mounted at a location between and adjacent said pedals, means located under said first beam adjacent said seat for pivoting said first beam.

3. A surface treatment system as recited in claim 2, comprising a second beam pivotally mounted at one end to said floor at a location under said seat and pivotted at the other and opposite said one end to said first beam at a location intermediate between said seat and said pedals, said means for pivoting said first beam being located between said floor and said second beam.

4. A surface treatment system as recited in claim 1, wherein said gun has a longitudinal axis and comprises a flexible nozzle, and means connected to said handles for flexing said nozzle in directions substantially extending up to 90 degrees with the axis of the gun.

5. A surface treatment system as recited in claim 4, comprising a pair of linking members longitudinally extending between said handles and said nozzle for bending said nozzle, said linking members disposed 90 degrees apart around the longitudinal axis of the gun for flexing said nozzle in a plurality of angular directions.

6. A surface treatment system as recited in claim 1, wherein the slit is covered by a flexible slotted curtain adapted to allow the free lateral movement of the gun therethrough.

7. A surface treatment system as recited in claim 1, wherein said stand comprises a first frame adapted to move parallel to said protecting wall, a second frame pivotally mounted on said first frame along an axis paralle to said protecting wall, and a third frame rotatably mounted above said second frame about an axis perpendicular to said second frame.

8. A surface treatment system as recited in claim 1, wherein the means for pivoting said stand comprises a first frame mounted on a horizontal axle substantially parallel to the wall, and a second frame mounted on said first frame about an axis perpendicular to said first frame, said article being adapted to be secured to said second frame.

9. A surface treatment system as recited in calim 8, comprising rails disposed parallel to said wall, and means for moving said stand along said rails.

* * * * *